US005164743A

United States Patent [19]

Hayashi et al.

[11] Patent Number: 5,164,743

[45] Date of Patent: Nov. 17, 1992

[54] HIGH SPEED PRINTER

[75] Inventors: Motohiko Hayashi, Yamatokoriyama; Sadaaki Shimonaga, Nara; Nobuhiro Tamura, Yamatokoriyama; Masayuki Hachinoda, Nara, all of Japan

[73] Assignee: Sharp Kabushiki Kaisha, Osaka, Japan

[21] Appl. No.: 462,460

[22] Filed: Jan. 9, 1990

[30] Foreign Application Priority Data

Jan. 10, 1989 [JP] Japan ..... 1-4021
Jan. 10, 1989 [JP] Japan ..... 1-4022

[51] Int. Cl.[5] ..... B41J 2/325; B41J 2/355

[52] U.S. Cl. ..... 346/76 PH; 400/120

[58] Field of Search ..... 346/76 PH; 400/120

[56] References Cited

U.S. PATENT DOCUMENTS 4,447,819 5/1984 Moriguchi et al. ..... 346/76 PH
4,454,516 6/1984 Moriguchi et al. ..... 346/76 PH

FOREIGN PATENT DOCUMENTS 0186257 10/1983 Japan ..... 346/76 PH
0212171 9/1987 Japan ..... 346/76 PH
0224972 9/1988 Japan ..... 346/76 PH

*Primary Examiner*—Benjamin R. Fuller
*Assistant Examiner*—Huan Tran

[57] ABSTRACT

When a number of exothermic elements arranged linearly are used for printing, driving data are inputted to the gate circuits of each exothermic element, and the gate circuits are controlled by the strobe signals in the conducting/nonconducting state. The circuit gates are divided into groups and the strobe signals different for each group are inputted in sequence. At printing, when there is the group having a relatively small number or no exothermic elements being heated and driven, and the strobe signal is given to each group successively for any groups, the necessary driving time may be wasted. The operating speed many be improved if a plurality of strobe signals are outputted in parallel when the number of exothermic elements being heated and driven is relatively small, and if the corresponding strobe signals are stopped when there is no exothermic element, and outputting the next strobe signals immediately in both cases.

5 Claims, 9 Drawing Sheets

PRIOR ART FIG. 1 (1) S1

PRIOR ART FIG. 1 (2) S2

PRIOR ART FIG. 1 (3) S3

PRIOR ART FIG. 1 (4) S4

PRIOR ART FIG. 1 (5) S5

PRIOR ART FIG. 1 (6) S6

PRIOR ART FIG. 1 (7) S7

PRIOR ART FIG. 1 (8) S8

PRIOR ART FIG. 1 (9) DA

PRIOR ART FIG. 1 (10) DA

FIG. 7(1) STR1
FIG. 7(2) STR2
FIG. 7(3) STR3
FIG. 7(4) STR4
FIG. 7(5) STR5
FIG. 7(6) STR6
FIG. 7(7) STR7
FIG. 7(8) STR8
FIG. 7(9) D
FIG. 7(10) D
W3
W4
W1
W2
DI
DI+1
DI+2
W11 (DI1)
W12 (DI2)
W13 (DI3)
W14 (DI4)
W15 (DI5)
W16 (DI6)
W17 (DI7)
W18 (DI8)

W4
W3
W2
DI+1
W1
DI
W11 (DI1)
W12 (DI2)
W13 (DI3)
W14 (DI4)
W15 (DI5)
W16 (DI6)
W17 (DI7)
W18 (DI8)
FIG.10(1) STR1
FIG.10(2) STR2
FIG.10(3) STR3
FIG.10(4) STR4
FIG.10(5) STR5
FIG.10(6) STR6
FIG.10(7) STR7
FIG.10(8) STR8
FIG.10(9) D
FIG.10(10) D

HIGH SPEED PRINTER

BACKGROUND OF THE INVENTION

1. Field of the Invention

The present invention relates to a printer preferably used in, for example, a facsimile.

2. Description of the Prior Art

Generally, a line-type thermal head is provided in a facsimile, in which a document image transmitted from the other facsimile is thermally recorded on a thermal sensitive paper by the line-type thermal head. Such line-type thermal head includes a plurality of exothermic elements aligned on a line, respective exothermic elements being selectively heated in response to print data.

In a conventional facsimile, the exothermic elements in one line are divided into several groups, for example, into eight groups, and the exothermic elements in respective groups are heated and controlled successively. Strobe signals S1 to S8 and the print data DA for heating the exothermic elements of respective groups in such facsimile are shown in FIG. 1.

The strobe signals S1 to S8 correspond separately to a plurality of groups divided into eight. Each exothermic element in respective groups is heated in response through the data signal DA when the corresponding strobe signal Si ($i=1\sim1$) is in a low level.

That is, as shown in FIG. 1 (9), the data signal DA includes, for example, data DA1 for one line in a period Wa, and as shown in FIG. 1 (10), the data DA1 is a serial signal representing in logic "1" and "0", whether or not each exothermic element of respective groups is heated in the period Wa1 to Wa8. The data DA for one line is stored, for example, in a shift register or the like. Each cell of the shift register corresponds separately to each exothermic element.

At start of a period Wc, data stored in the shift register are latched respectively in a latch circuit having cells corresponding separately to respective cells of the shift register. In the period Wc, the strobe signals S1 through S8 are pulse signals which become low level in sequence. While the strobe signals Si corresponding to respective groups are low level, the exothermic elements to be heated in the groups are heated in response to the latch circuit data.

At the start of a period Wd following the period Wc, the data DA1 of the shift register is latched in the latch circuit. In the period Wd, the strobe signals S1 through S8 become low level successively the same as in the period Wc previously described, and respective exothermic elements are heated in response to the data DA1 to thereby effect printing. In a period Wb within the period Wd, print data DA2 of the next line are led out and stored in the shift register. By repeating such operations while the thermal sensitive paper is transferred, image information transmitted from the other facsimile are recorded on the thermal sensitive paper.

Meanwhile, there is a fervent desire to speed up the communication speed of image information of the facsimile, thus manufactures of the facsimile, besides a communication system standardized by CCITT (a Consulting Committee of International Telegraph and Telephone), decide their own communication system to manufacture the facsimile capable of communicating the image information more speedily. As the communication speed of the image information is increased as such, it is indispensable to improve the printing speed in the facsimile.

In the printing system described above, in order to improve the printing speed without deteriorating printing quality, there is a method of reducing the heating time of respective exothermic elements by employing a low resistance value of each exothermic element and applying a large current to each exothermic element. In this method, such a problem is encountered that an expensive exothermic element having a low resistance value is required. Though a power circuit supplying the current for heating the exothermic element is constructed to supply the current sufficient to heat all of the exothermic elements in one group, when improving the printing speed in this method, the power circuit must be designed to supply the larger current.

In another method, printing is executed by dividing the exothermic elements constituting the line-type thermal head into small groups, for example, into four groups. In this case, in order to maintain the printing quality, since the total number of exothermic elements can not be reduced and a number of exothermic elements are included in each group, the number of exothermic elements being heated simultaneously increases. Accordingly, the power circuit must still be designed to supply the large current.

As such, in the two methods aforementioned, a powerful power circuit is required to supply a predetermined current to the exothermic elements, resulting in an expensive and large-sized apparatus.

SUMMARY OF THE INVENTION

It is, therefore, an object of the present invention to provide a printer capable of improving the printing speed without being enlarged.

The invention is directed to a printer including a first plurality of printing elements and driving signal generating means generating the driving signal for dividing the printing elements into second plurality of groups below the first plurality of, and selecting each group to drive the printing elements of the group, wherein while the driving signal is outputted for the selected group, the printing elements are driven in response to print data to effect printing, further comprising;

print data output means for outputting the print data, counting means for counting the number of printing elements to be driven for each group responding to the print data from the print data output means, and comparison means for comparing a sum of count values of the counting means in third plurality of groups below the second plurality and a predetermined value, wherein the driving signal generating means, in response to the output of the comparison means, outputs the driving signal for selecting the third plurality of group when the sum of the count values of the counting means is smaller than the predetermined value, thereafter executing an output operation of the driving signal with respect to the group following immediately after.

The invention is directed to a printer including first plurality of printing elements and driving signal generating means generating the driving signal for dividing the printing elements into second plurality of groups below the first plurality of, and selecting each group to drive the printing element of the group, wherein while the driving signal is outputted for the selected group, the printing elements are driven in response to print data to effect printing, further comprising;

print data output means for outputting the print data, and counting means for counting the number of printing elements to be driven for each group, responding to the print data for the print data output means, wherein the driving signal generating means, when the count value of the counting means is zero, does not output the driving signal for selecting the group corresponding to the count value to the printing element, but executing the output operation of the driving signal for selecting the following group.

In the printer according to the invention, the first plurality of printing elements are divided into the second plurality of groups. The printing elements in each group are driven in response to the print data from the print data output means, while the driving signal from the driving signal generating means is outputted.

According to the invention, the counting means responds to the print data from the print data output means, and counts the number of printing elements to be driven for each group. The comparison means compares a sum of count values of the counting means in the third plurality of group and a predetermined value, and outputs a signal representing the comparison result to the driving signal generating means. In response to the signal, the driving signal generating means outputs a driving signal for selecting the third plurality of groups when the sum of the count values is smaller than the predetermined value, thereby the printing elements of the third plurality of groups are selectively driven simultaneously in response to the print data. When the sum of the count values is larger than the predetermined value, the driving signal generating means outputs a driving signal for selecting one group to drive it, thereby the printing elements in the group are driven selectively in response to the print data.

Thus, when the printing elements to be driven are relatively few, since the printing elements in the third plurality of groups are driven simultaneously, the printing speed can be improved without increasing the number of printing elements driven at the same time.

In the printer according to the invention, the printing elements in the first plurality of groups are divided into the second plurality of groups. The printing elements in each group are driven in response to the print data from the print data output means, while the driving signal is outputted from the driving signal generating means.

According to the invention, the counting means, responding to the print data from a control circuit, counts the number of printing elements to be driven for each group. To the driving signal generating means, a signal from the counting means is inputted when the count value of the counting means is zero. In response to the signal, the driving signal generating means, when the count value is zero, does not output the driving signal for selecting and driving printing means of the group corresponding to the count value, but selecting the following group to execute the output operation of the driving signal for driving the printing elements in the group.

Accordingly, the printing elements of each group are driven in response to the print data corresponding to respective printing elements from the print data output means, while the driving signal is outputted, and when the printing element to be driven is absent in a certain group, the driving signal for selecting the group is not outputted. Thus, a time for outputting the unnecessary driving signal is not needed, so that the printing speed can be improved without increasing the number of printing means which are driven at the same time.

BRIEF DESCRIPTION OF THE DRAWINGS

These and other objects of the invention, as well as the features and advantages thereof, will be better understood and appreciated in the following detailed description taken in conjunction with the drawings, in which.

DETAILED DESCRIPTION OF THE PREFERRED EMBODIMENT

Figure 2:
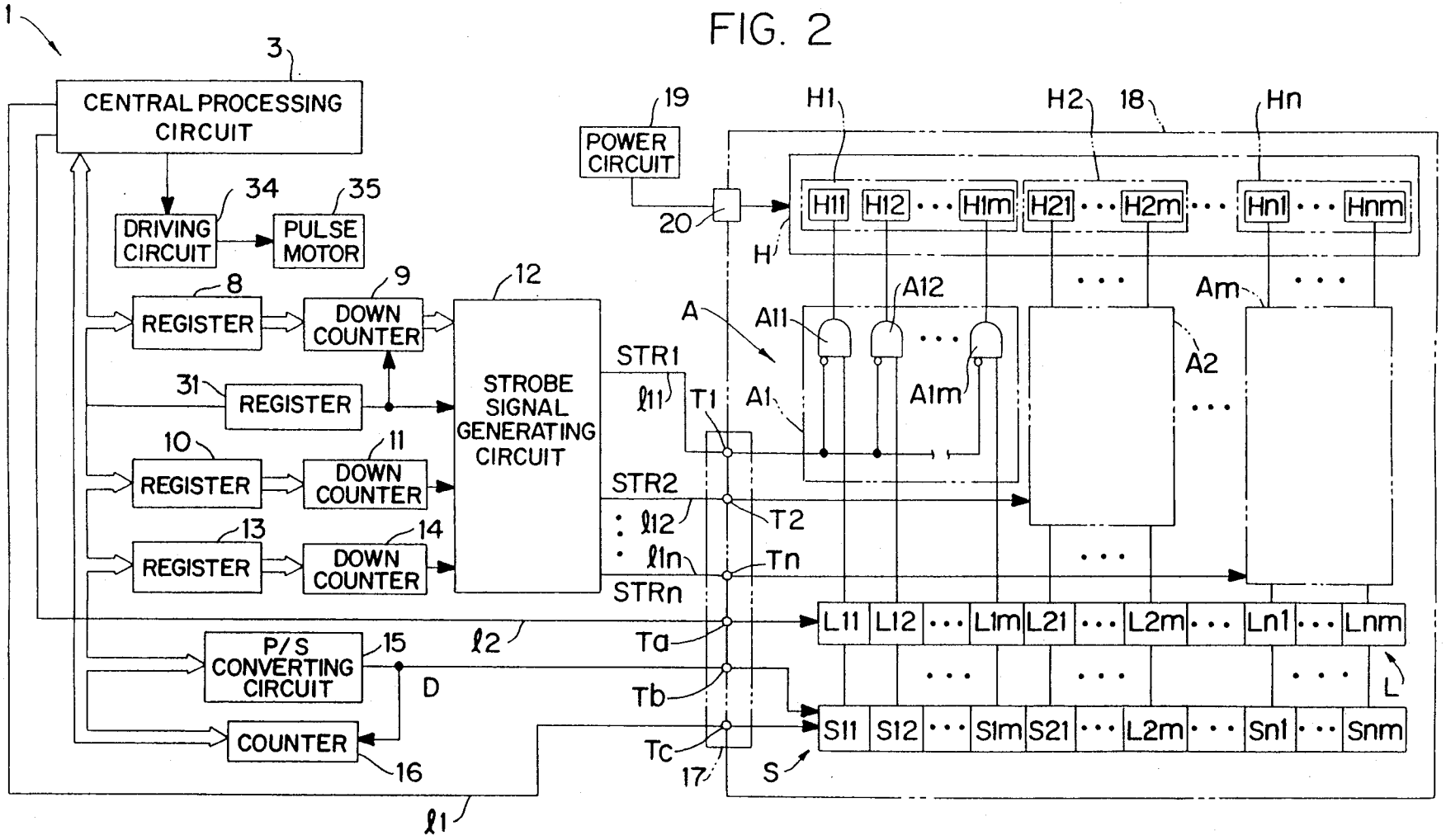
FIG. 2 is a block diagram showing the configuration of a recorder 1 which is a printer of one embodiment of the present invention.
Figure 3:
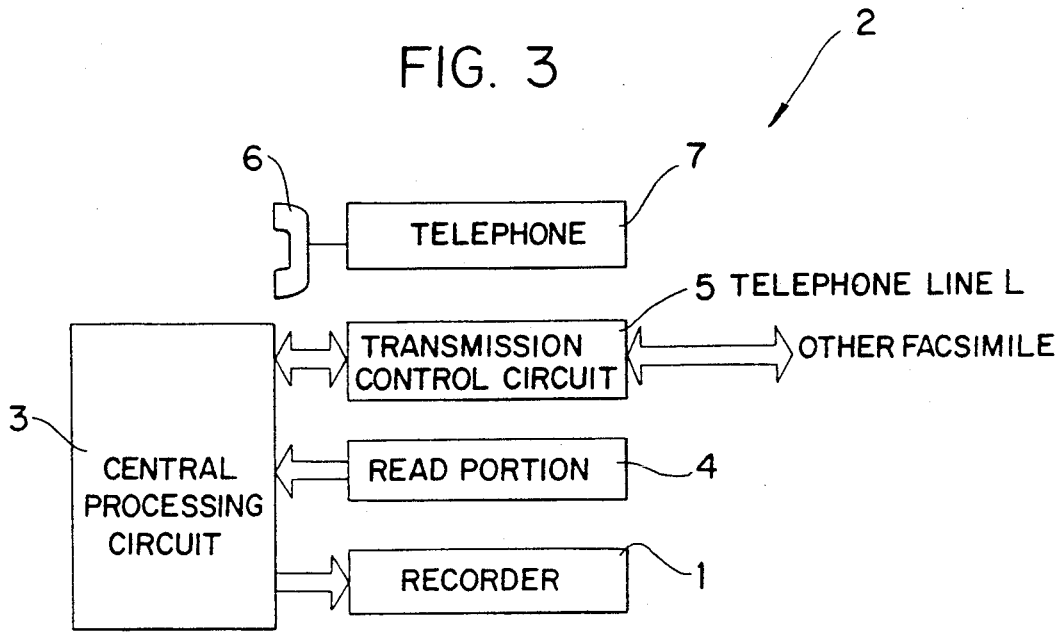
FIG. 3 is a block diagram schematically showing the configuration of a facsimile 2 employing a recorder 1.

FIG. 2 is a block diagram showing the configuration of a recorder 1 which is one embodiment of the present invention, and used in a facsimile and the like. FIG. 3 is a block diagram schematically showing the configuration of the facsimile 2 including the recorder 1. Referring to FIG. 3, the facsimile 2 comprises a central processing circuit 3 which is comparison means and print data output means, a read portion 4 for reading a document image, the recorder 1 which is a component element of a printer according to the invention for recording image information from a telephone line L, and a transmission control circuit 5 for transmitting and receiving the image information via the telephone line L.

In the facsimile 2, when the document image is read and transmitted to the telephone line L, it is read by a one-dimension type image sensor (not shown) or the like by the read portion 4 and outputted to the central processing circuit 3 as the image information. The central processing circuit 3 encodes the image information by data condensing processing and outputs it to the transmission control circuit 5. The transmission control circuit 5 modulates the encoded signal and sends the modulated signal out to the telephone line L. The document image of the read portion 4 is transmitted to the facsimile on the other side via the telephone line L in a similar manner.

In the facsimile 2, when the image information from the other facsimile is received, the image information from the telephone line L is demodulated by the transmission control circuit 5 and led out to the central processing circuit 3. The central processing circuit 3 encodes the image information and outputs the encoded information to the recorder 1, in which the image is recorded on a thermal sensitive paper or the like. A telephone 7 and a hand set 6 etc. are connected to the transmission control circuit 5 to realize the telephone function.

In the following, the configuration of the recorder 1 will be described with reference to FIG. 2. The recorder 1 comprises a pulse motor 35 for conveying recording paper such as the thermal sensitive paper, a strobe signal generating circuit 12 as the driving signal generating means, a counter 16 as the counting means and a recording head 18. In the recording head 18, a plurality of exothermic elements Hll through Hnm as printing elements are provided by mn pieces which are the first plurality. The exothermic elements Hll through Hnm are divided into the second plurality, for example, eight exothermic element groups H1 through Hn (n=8) for every m piece. The exothermic elements of the exothermic element groups H1 through Hn are generally represented by a reference character "H". In FIG. 2, though the exothermic elements H are divided into each group in diversified forms depending upon the size of the recording paper, for simplicity, each exothermic element group Hj (j=1,2, . . . , n) is consisting of a fixed number, for example, 256 of exothermic elements Hj1 through Hjm (m=256). In FIG. 2, the recording head 18 is represented by an equivalent circuit in such a case.

When the thermal sensitive paper is recorded in the recorder 1, print data outputted from the central processing circuit 3 are given in 8-bit parallel to a parallel/-serial converter (hereinafter referred to as "P/S converter") 15. The print data converted into serial signals by the P/S converter 15 are given to the recording head 18 via a terminal Tb of a connector 17 and also to the counter 16. The counter 16 counts the number of data indicating heating of the exothermic element, for example, the logic "1" among the print data outputted from the P/S converter 15, and the counted results are read by the central processing circuit 3.

Input and output of the print data and the counting operation of the counter 16 are executed for each exothermic element group Hj.

In the recorder 1, a down counter 11 is disposed for generating a timing signal to the low-level strobe signal to be described later. To the down counter 11, a predetermined initial value is outputted from the central processing circuit 3 via a register 10. For setting a low-level period of the strobe signal, a down counter 14 is provided, to which a predetermined initial value is given from the central processing circuit 3 via a register 13. Though the initial values of the down counters 11, 14 may be changed for each line or corresponding to each exothermic element group Hj, for simplicity, the initial values of the down counters 11, 14 are described as fixed. When the count values of the down counters 11, 14 become "0", the timing signal is outputted respectively to the strobe signal generating circuit 12.

Meanwhile, the central processing circuit 3 outputs, for example, 8(=n)-bit parallel data to a down counter 9 via a register 8. All bits of the data are logic "1". The central processing circuit 3 executes the operation processing in response to the count value read from the counter 16, and outputs the result to a register 31. An initial value of the down counter is set in response to outputs from the registers 8 and 31. The output from the register 31 is also given to the strobe signal generating circuit 12.

The strobe signal generating circuit 12 leads out strobe signals STR1 through STRn to the recording head 18 via lines l11 through l1n and terminals T1 through Tn of the connector 17. At this time, the strobe signal generating circuit 12 leads out the strobe signals STR1 through STRn which are the pulse signals decided by the signals from the down counters 11, 14, to each or plural lines l1j selected in response to the data from the register 31 and the down counter 9. In such a manner, the strobe signals STR1 through STRn are generated in the strobe signal generating circuit 12.

The central processing circuit 3, for controlling the pulse motor 35 which conveys the recording paper, outputs the control signal to the pulse motor 35 via a driving circuit 34.

The recording head 18 comprises a shift register S, a latch circuit L, an "AND" circuit A and exothermic elements H. Print data from the P/S converter 15 aforementioned are inputted to the shift register S via the terminal Tb of the connector 17. The shift register S is constituted by cells S11 through Snm corresponding separately to respective exothermic elements H11 through Hnm, and shifts the print data D successively in synchronism with the serial clock pulse inputted from the central processing circuit 3 via the line l1 and a terminal Tc of the connector 17. Thereby, the print data for one line is stored in the shift register S. Respective cells Sji (j=1 to n, i=1 to m) of the shift register S are connected respectively to respective cells Lji constituting the latch circuit L.

The latch circuit L latches the print data of the shift register S by the latch signal given from the central processing circuit 3 via the line l2 and a terminal Ta of the connector 17, and outputs to the "AND" circuit A.

The "AND" circuit A is constituted by "AND" circuit A1 through An corresponding separately to respective exothermic element groups H1 through Hn, each "AND" circuit Aj having an AND gate Aji corresponding separately to each exothermic element Hji. To one input terminal of the AND gate Aji for each "AND" circuit Aj, the strobe signal STRj inputted via the terminal Tj and reversed is given in common. To the other input terminal, a signal from the cell Lji of the latch circuit L corresponding to the AND gate Aji is inputted. The output of the AND gate Aji is given to the exothermic element Hji. Each exothermic element Hji includes a switching element such as a transistor and a resistor, the switching element being conductive when the output of the AND gate Aji is in a high level. The exothermic element Hji is also connected to a power circuit 19 via a connector 20, and becomes exothermic by a current supplied to the resistor from the power circuit 19 when the switching element is in conduction.

Figure 4:
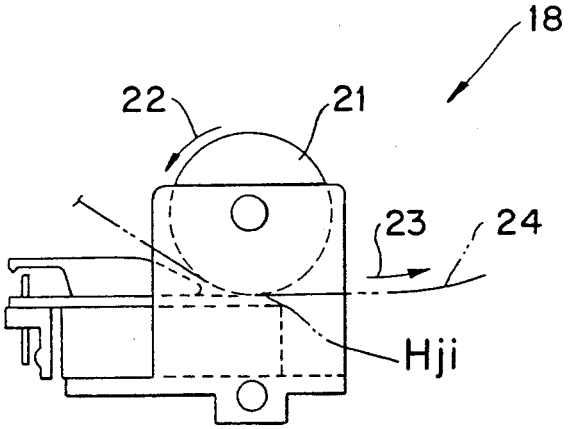
FIG. 4 is a side view of a recording head 18 of the recorder 1.
Figure 5:
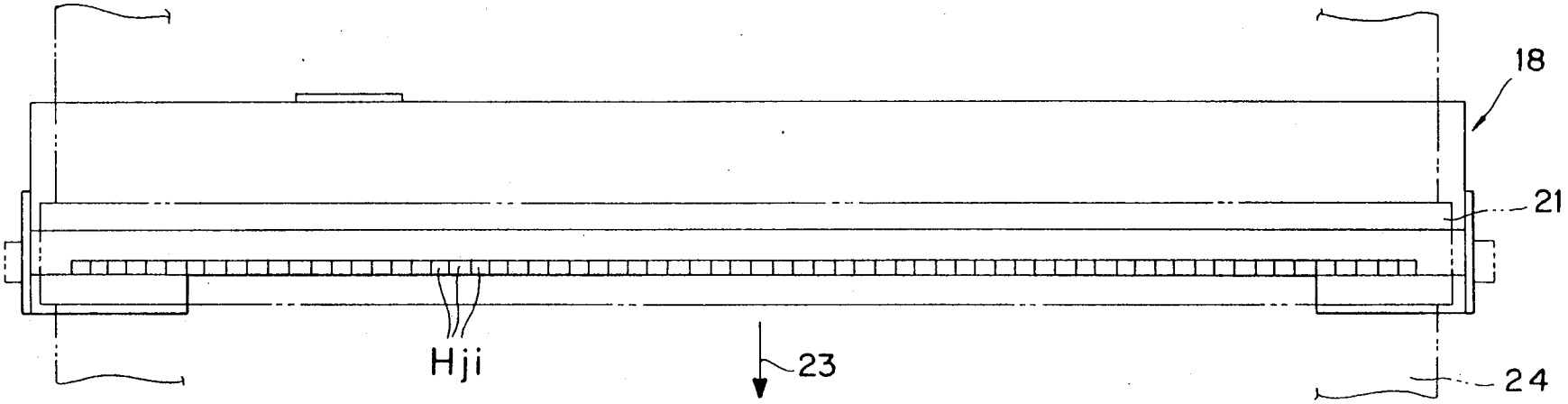
FIG. 5 is plan view of a recording head 18.
Figure 6:
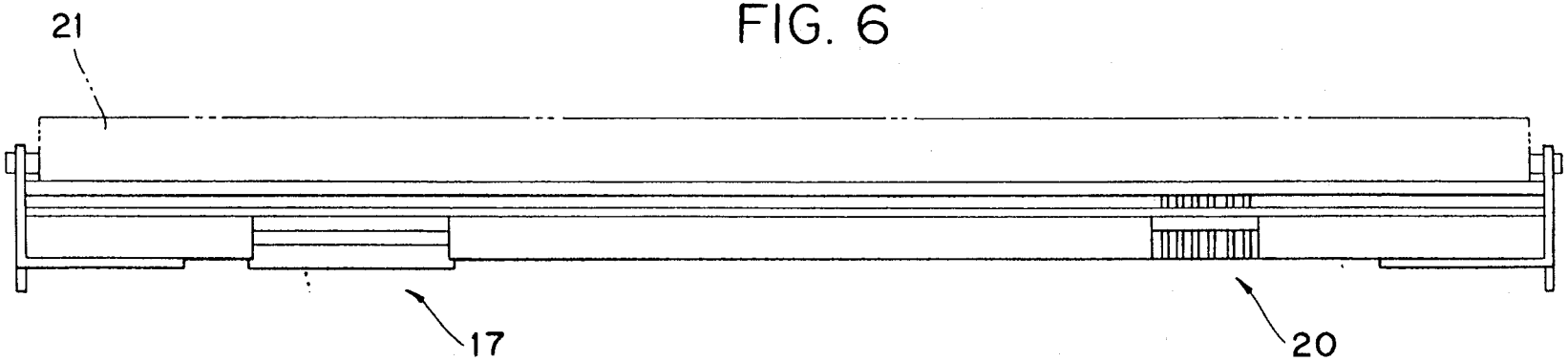
FIG. 6 is a rear elevation of the recorder 1.

FIG. 4 is a side view showing an appearance of the neighborhood of the recording head 18, FIG. 5 is a plan view of the recording head 18 and FIG. 6 is a rear elevation thereof. In the recording head 18, as shown in FIG. 5, respective exothermic elements Hji are arranged longitudinally along the recording head 18. On the side facing the exothermic elements Hji, a platen roller 21 is disposed, and a thermal sensitive paper 24 is clamped between the platen roller 21 and the exothermic elements Hji. The platen roller 21 is driven to rotate in the direction of the arrow 22 by the aforesaid pulse motor 35, thereby conveying the thermal sensitive paper 24 in the direction of the arrow 23. At this time, the central processing circuit 3 controls the conveying speed of the thermal sensitive paper 24 by changing a pulse period outputted to the pulse motor 35, responsive to the length of the transmitting period of image information for one line and the lead-out period of the strobe signals STR1 through STRn. Thereby, the document image is recorded properly even when the printing speed for one line is changed. By selectively heating respective exothermic elements Hji in such a state, the image is recorded on the thermal sensitive paper 24.

On the rear side of the recording head 18, as shown in FIG. 6, the connector 17 for inputting the strobe signals and the connector 20 inputting a power supplied from the power circuit 19 to energize the exothermic elements Hji are disposed. The power circuit 19 is able to supply the current for heating, for example, 256 (=m) exothermic elements Hji included in one exothermic element group Hi simultaneously.

Figure 7:
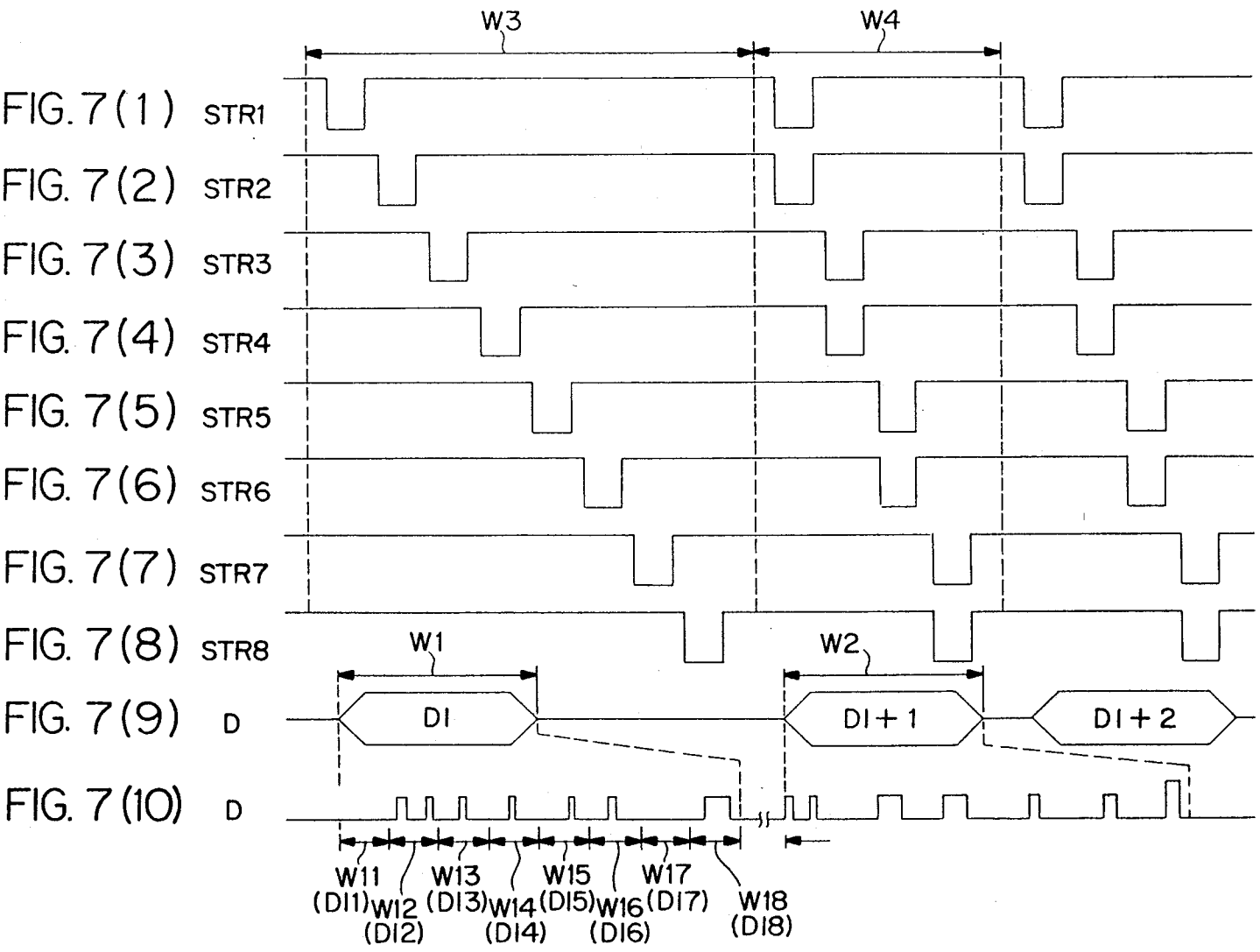
FIG. 7 is a timing chart for explaining an operation of the recorder 1.

FIG. 7 is a timing chart for explaining the operation timing of the strobe signals STR1 to STR8 and print data D. As shown in FIGS. 7 (1) through 7 (8), respective strobe signals STR1 through STR8 are pulse signals which, in the period W3, become low level in sequence. The period W3 shows, as will be described later, the case wherein, in the print data latched by the latch circuit L, a total number of exothermic elements to be heated in either of sets of two exothermic element groups H2x-1 and H2x (x=1,2,3,4) which are the third plurality, exceeds 256. In such a case, as described in association with the prior art, while the strobe signal STRj becomes low level, in the exothermic element group Hi corresponding to the strobe signal STRj, the exothermic element corresponding to logic "1" in the print data is heated.

In the period W3, as shown in FIG. 7 (9), the print data D of the following line is led out in a period W1 and stored in the shift register S.

As shown in FIG. 7 (10), the print data D is led out as a serial signal corresponding to each exothermic element group Hj in every period W1j. Hereinafter, the print data Dl led out in the period W1j is represented by a reference character "Dlj". For example, when a total number of data which are logic "1" in all of the sets of a pair of print data Dl2x-1, Dl2x (x=1,2,3,4,5) is below a predetermined value CT0 (=256), respective pulses of the strobe signals STR2x-1 and STR2x are led out simultaneously in the period W4 following the period W3 as to be described later. In this connection, the period W4 is about one half of the period W3. In the period W4, similar to the case aforementioned, print data Dl+1 in the next line is led out.

Figure 8:
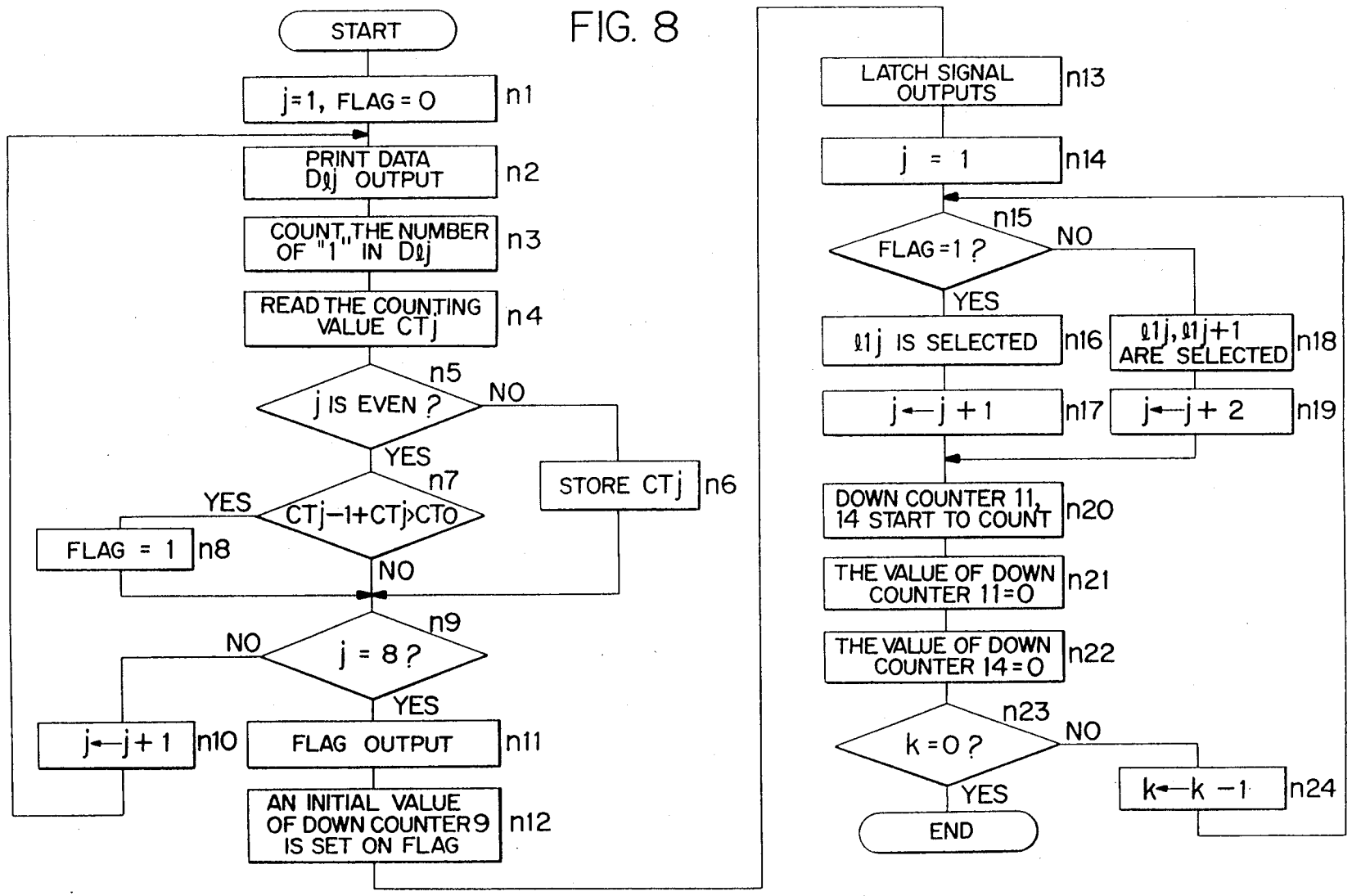
FIG. 8 is a flow chart for explaining an operation of the recorder 1.

In the following, a recording operation of the recorder 1 in one line will be described with reference to a flow chart of FIG. 8. When one line is recorded, first a value of a parameter j is set to an initial value 1 in step n1, and a Flag is set to "0". Then, in step n2, print data Dlj related to the exothermic element Hji of the exothermic element group Hj corresponding to the parameter j is outputted from the central processing circuit 3. The print data Dlj is converted into the serial signal in the P/S converter 15, and in step n3, the counter 16 counts the number of logic "1" or the number of exothermic elements Hji to be heated. When the print data of one exothermic element group Hj has been counted, a count value (CTj of the counter 16 is read out by the central processing circuit 3 is step n4. In step n5, it is judged whether the value of the parameter j is an even number. When it is an odd number, the procedure is moved to step n6, wherein the count value CTj of the counter 16 is stored in a memory included in the central processing circuit 3, and the procedure moves to step n9. When the parameter j is an even number in step n5, the procedure is moved to step n7, wherein it is judged whether a sum of the previous count value CTj-1 and the new count value CTj of the counter 16 exceeds a predetermined value CT0 (=256). When CTj-1+CTj>CT0, the procedure moves to step n8, setting a Flag to "1" and proceeding to step n9 to be described later. When CTj-1+CTj≦CT0 in step n7 and processing in steps n6 and n8 are completed, the procedure proceeds to step n9 to judge whether j=8. In the case of j≠8, the value of the parameter j is incremented by +1 in step n10 and the procedure is returned to step n2 to repeat the same operation.

When it is j=8 in step n9, the procedure proceeds to step n11, wherein a Flag is outputted to the register 31 from the central processing circuit 3. Thereby, in step n12, an initial value of the down counter 9 is set. That is, when Flag=0, the initial value of the down counter 9 is set. That is, when Flag=0, the initial value of the down counter 9 is set to "8", and when Flag≠0, the initial value of the counter 9 is set to "4".

Thereafter, in step n13, the print data Dl led out to the shift register S is latched by the latch circuit L and the print data Dl is led out to the "AND" circuit A.

In step n14 onward, the generating operation of the strobe signal in the strobe signal generating circuit 12 is executed. When generating the strobe signal, the parameter j is set to an initial value of j=1 in step n14.

In step n15, the strobe signal generating circuit 12 judges whether the Flag from the register 31 is "1". When Flag=1, the procedure is moved to step n16, wherein a line l1j corresponding to the parameter j is selected and the parameter j is incremented in step n17. When Flag=0 in step n15, the procedure moves to step n18 to select two lines including the line l1j and line l1j+1, and in step n19, the parameter j is incremented by "2".

When the processings in steps n17 and n19 are completed, the procedure moves to step n20, wherein the down counters 11, 14 start counting down from the predetermined initial values. The initial value of the down counter 11 is set smaller than that of the down counter 14, so that the count value of the down counter 11 becomes "0" in step n21, and thereafter in step n22, the count value of the down counter 14 becomes "0".

Till the count value of the down counter 14 becomes "0" after the count value of the down counter 11 had become "0", the strobe signal generating circuit 12 leads out the low level pulse signal as the strobe signal to the line selected in step n16 or step n18.

Thereafter, in step n23, it is judged whether the count value k of the down counter 9 is "0", in the case of K≠0, the count value k of the down counter 9 is decremented by −1 in step n24, and the procedure is returned to step n15 aforementioned to repeat the same operation. When k=0 in step n23, the printing operation of the line is completed. As described with reference to FIG. 6, in the operations in step n14 onward, the lead-out operations of print data of the following line are executed in parallel.

As such, in the present embodiment, the exothermic element Hji is heated selectively while the strobe signal STRj led out for each exothermic element group Hj is low level, and when a total number of exothermic elements to be heated in a pair of exothermic element groups H2x-1 and H2x is relatively small such as below 256, a pair of strobe signals STR2x-1 and STR2x are led out simultaneously in the line. Thus, when the number of exothermic elements to be heated in one line is small, since two strobe signals STR2x-1 and STR2x are outputted simultaneously, the printing speed can be improved without increasing the number of exothermic elements being heated at the same time. In particular, in the facsimile and the like, in general, there are large blank spaces in a document which are not needed to be printed, so that the printing speed can be considerably improved. Besides, since the exothermic element groups which are heated simultaneously are not increased, the high printing speed can be realized without providing a powerful power circuit and increasing the cost and size of the apparatus.

In the embodiment, though the strobe signals STR2x-1 and STR2x are outputted at the same time in the line, when the number of exothermic elements heated in the exothermic element groups H2x-1 and H2x in one line is below 256, the strobe signals STRj and STRj+1 may be outputted when the number of exothermic elements heated in the adjoining exothermic element groups Hj and Hj=1 is below, for example, 256. It is also possible to heat the exothermic elements simultaneously in two or more groups. It is to be understood that the reference count value CTO is not limited to 256.

In the embodiment, though the case wherein the invention is embodied in a facsimile including exothermic elements H as the line-type thermal head has been described, it will be appreciated that it is not limited to the facsimile or the line-type thermal head, the invention can also be employed in connection with a common printer.

Figure 9:
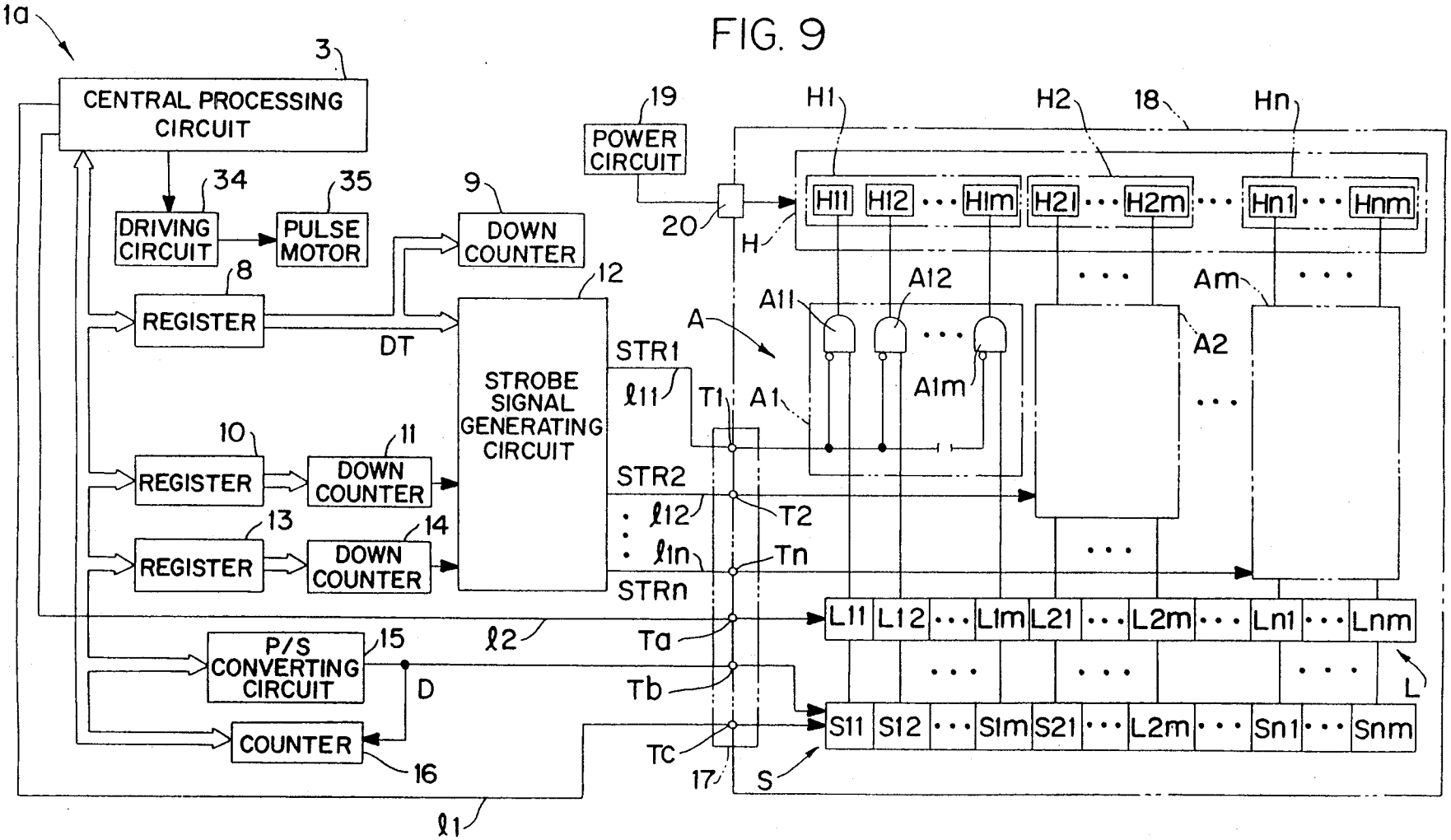
FIG. 9 is a block diagram showing the configuration of a recorder which is a printer of another embodiment of the invention.

FIG. 9 is a block diagram showing the configuration of a recorder 1*a* which is another embodiment of the invention, and used in a facsimile and the like. The recorder 1*a* is used in the facsimile 2 described with reference to FIG. 3 in a same manner as the recorder 1 of the embodiment described before. Explanation of the facsimile 2 will be omitted.

Figure 1:
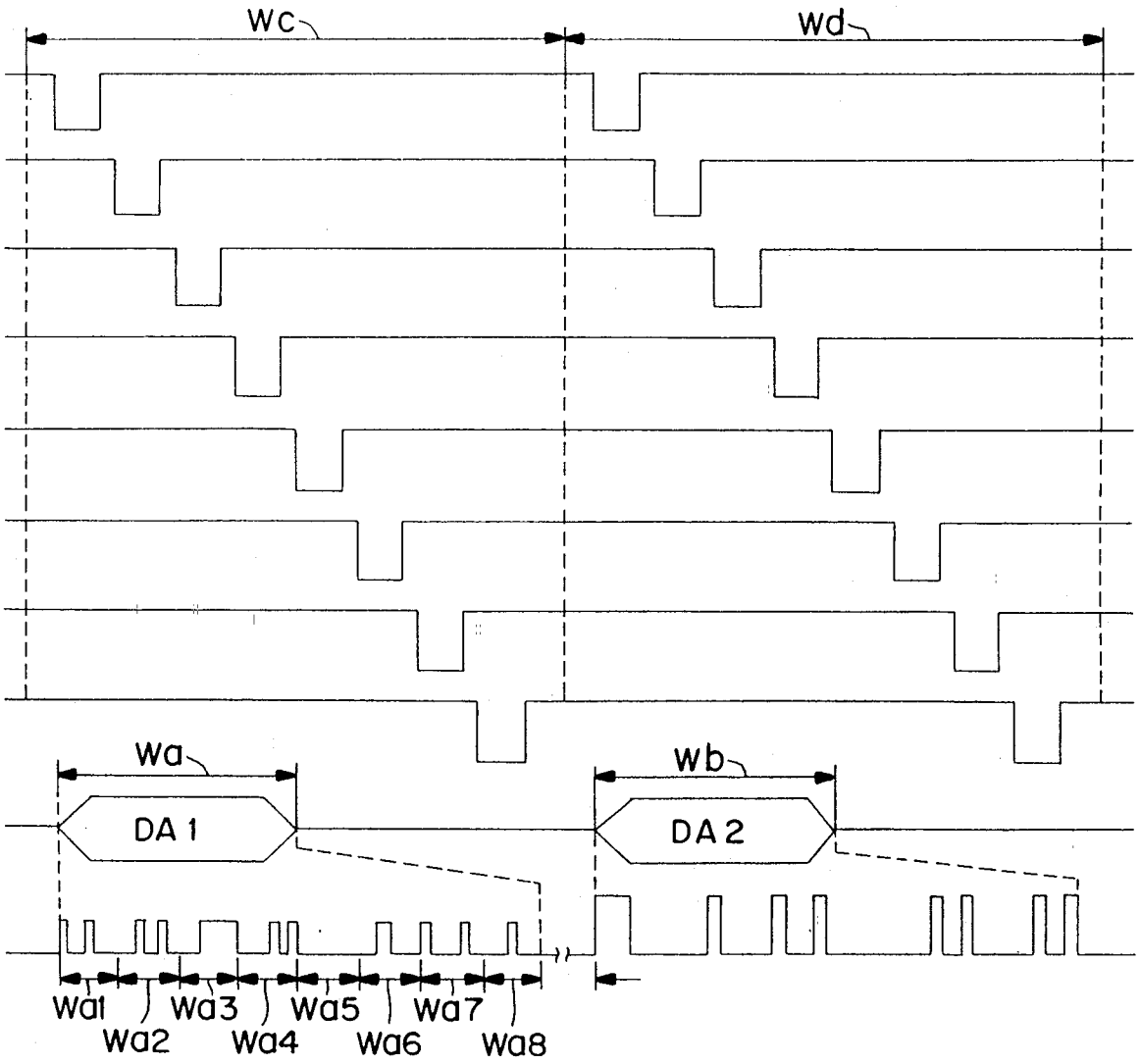
FIG. 1 is a timing chart for explaining a printing operation in a prior art printer.

In the following, the configuration of the recorder 1*a* will be described with reference to FIG. 9. The recorder 1*a* comprises a pulse motor 35 for coveying recording paper such as a thermal sensitive paper, a strobe signal generating circuit 12 as driving signal generating means, a counter 16 as counting means and a recording head 18. In the recording head 18, a plurality of exothermic elements H11 through Hnm are disposed as the printing elements, and the exothermic elements H11 through Hnm are divided into a plurality of, for example eight, exothermic element groups H1 to Hn (n=8). The exothermic elements of the exothermic element groups H1 through Hn are generically represented by a reference character "H". In FIG. 1, though the exothermic elements H are divided into each group in diversified forms depending upon the size of the recording paper, for simplicity, each exothermic element group Hj (j=1,2, . . . , n) is consisting of a fixed number, for example, 256 of exothermic elements Hj1 through Hjm (m=256). In FIG. 9, the recording head 18 is represented by an equivalent circuit in such a case.

When the thermal sensitive paper is recorded in the recorder 1*a*, print data outputted from the central processing circuit 3 are given, for example, in 8-bit parallel to a parallel/serial converter (hereinafter referred to as "P/S converter") 15. The print data D converted into serial signals by the P/S converter 15 are given to the recording head 18 via a terminal Tb of the connector 17 and also to the counter 16. The counter 16 counts the data indicating heating of the exothermic elements, the example, the number of logic "1" among the print data outputted from the P/S converter 15, and the counted results are read by the central processing circuit 3. Input and output of the print data and a counting operation in the counter 16 are executed for each exothermic element group Hj.

In the recorder 1*a*, a down counter 11 is disposed for generating a timing signal to low level the strobe signal to be described later. To the down counter 11, a predetermined initial value is outputted from the central processing circuit 3 via a register 10. For setting a low level period of the strobe signal, a down counter 14 is provided, to which a predetermined initial value is given from the central processing circuit 3 via a register 13. Though the initial values of the down counters 11, 14 may be changed for each line or corresponding to each exothermic element groups Hj, for simplicity, the initial values of the down counters 11, 14 are described as fixed. When the count values of the down counters 11, 14 become "0", the signal is outputted to the strobe signal generating circuit 12.

Furthermore, the central processing circuit 3 outputs, in response to the count value read out from the counter 16, for example, 8(=n)-bit parallel data DT to the strobe signal generating circuit 12 via a register 8. The data DT from the register 8 is given also to a down counter 9, thereby setting an initial value thereof.

The strobe signal generating circuit 12 leads out strobe signals STR1 through STRn to the recording head 8 via lines l11 through l1n and terminals T1 through Tn of the conductor 17. At this time, the strobe signal generating circuit 12 leads out the strobe signals STR1 through STRn which are the pulse signals decided by the signals from the down counters 11, 14, to the line l1j selected in response to the data from the register 8 and the down counter 9. In such a manner, the strobe signals STR1 through STRn are generated in the strobe signal generating circuit 12.

The central processing circuit 3, for controlling the pulse motor 35 which conveys the recording paper, outputs the control signal to the pulse motor 35 via a driving circuit 34.

The recording head 18 comprises a shift register S, a latch circuit L, and "AND" circuit A and exothermic elements H. Print data from the P/S converter 15 aforementioned are inputted to the shift register S via the terminal Tb of the connector 17. The shift register S is constituted by cells S11 through Snm corresponding separately to respective exothermic elements H11 through Hnm, and shifts the print data successively in synchronism with the serial clock pulse inputted from the central processing circuit 3 via the line l1 and a terminal Tc of the connector 17. Thereby, the print data for one line is stored in the shift register S. Respective cells Sji (j=1 to n, i=1 to m) of the shift register S are connected to respective cells Lji constituting the latch circuit L.

The latch circuit L latches the print data of the shift register S by the latch signal given from the central processing circuit 3 via the line 2 and a terminal Ta of the connector 17, and outputs to the "AND" circuit A.

The "AND" circuit A is constituted by the "AND" circuits Al to An corresponding separately to respective exothermic element groups H1 through Hn, each "AND" circuit Aj having an AND gate Aji corresponding separately to each exothermic element Hji. To one input terminal of the AND gate Aji for each "AND" circuit Aj, the strobe signal STRj inputted via a terminal Tj and reversed is given in common. To the other input terminal, a signal from the cell Ji of the latch circuit L corresponding to the AND gate Aji is inputted. The output of the AND gate Aji is given to the exothermic element Hji. Each exothermic element includes a switching element such as a transistor and a resistor, the switching element being conductive when the output of the AND gate Aji is in a high level. The exothermic element Hji is also connected to a power circuit 19 via a connector 20, and becomes exothermic by a current supplied to the resistor from the power circuit 19 when the switching element is in conduction.

Appearance of the neighborhood of the recording head 18 of the recorder 1*a* and the shape and construction thereof are similar to those described with reference to FIGS. 4 through 6, so that a third repetitive explanation will be omitted.

Figure 10:
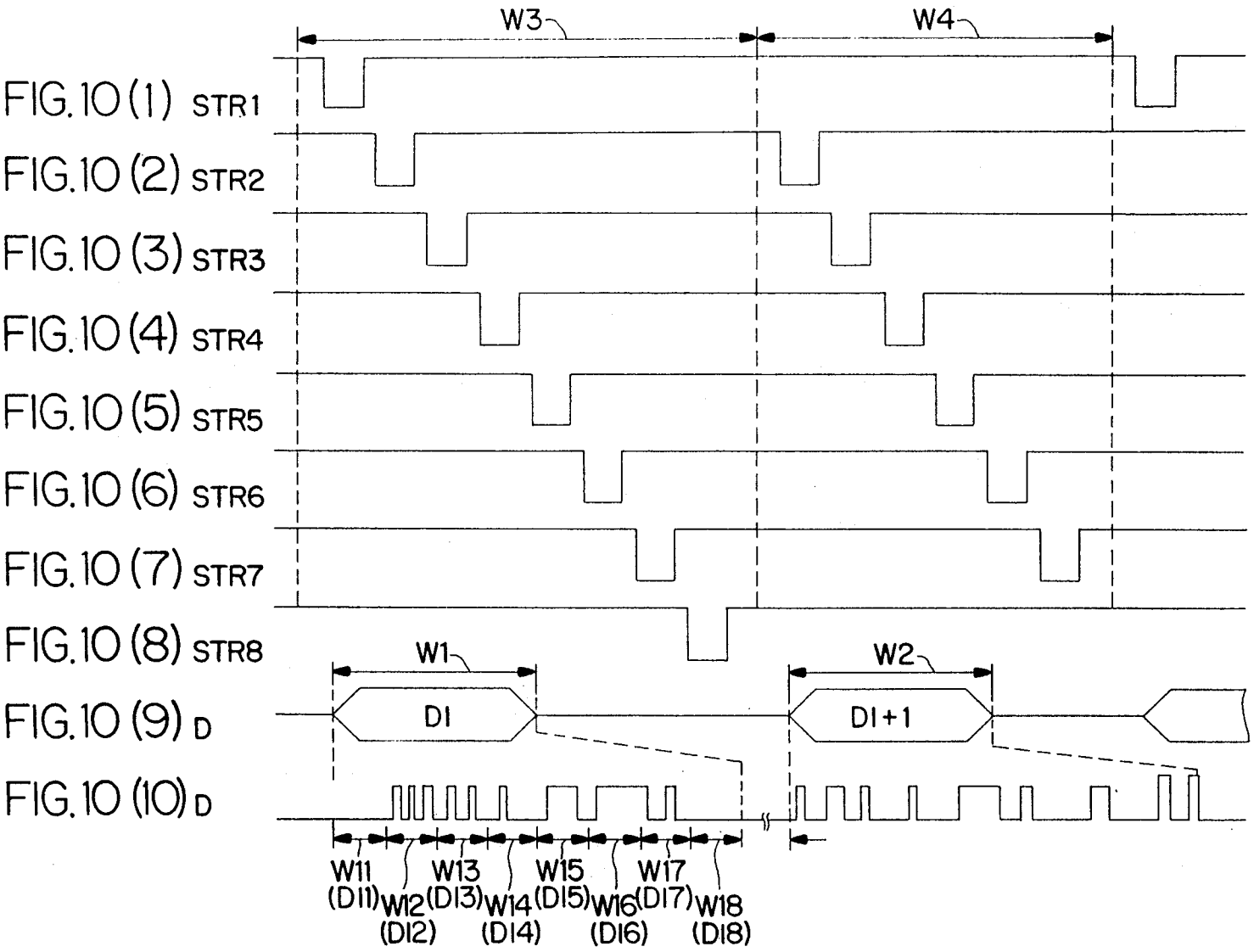
FIG. 10 is a timing chart for explaining an operation of the recorder 1*a*.

FIG. 10 is a timing chart for explaining the operation timing of the strobe signals STR1 through STR8 and print data D. As shown in FIGS. 10 (1) through 10 (8), respective strobe signals STR1 through STR8 are, in a period W3, pulse signals which become low level in sequence. The period W3 shows the case wherein, in the print data latched by the latch circuit L, the logic "1" is included in the print data corresponding to respective exothermic element groups Hj, or at least one exothermic element to be heated is present in all of the exothermic element groups H1 through Hn. In such a case, as described in association with the prior art, while the strobe signal STRj becomes low level, in the exothermic element groups Hj corresponding to the strobe signal STRj, the exothermic element corresponding to logic "1" in the print data is heated.

In the period W3, as shown in FIG. 10 (9), the print data Dl of the following line is led out in the period W1 and stored in the shift register S.

As shown in FIG. 10 (10), the print data Dl is led out as a serial signal corresponding to each exothermic element group Hj in every period W1j. Hereinafter, the print data Dl led out in the period W1j is represented by a reference character "Dlj". For example, when all of the exothermic elements in the exothermic element groups H1 and H8 are not heated, as shown in FIG. 10 (10), the print data Dl1 and Dl8 are always logic "0".

In such a case, in the period W4 following the period W3, the strobe signals STR1 and STR8 are not led out, and in this connection the period W4 is shorter than the period W3. Similar to the case previously described, the print Dl+1 of the following line is led out in the period W4.

Figure 11:
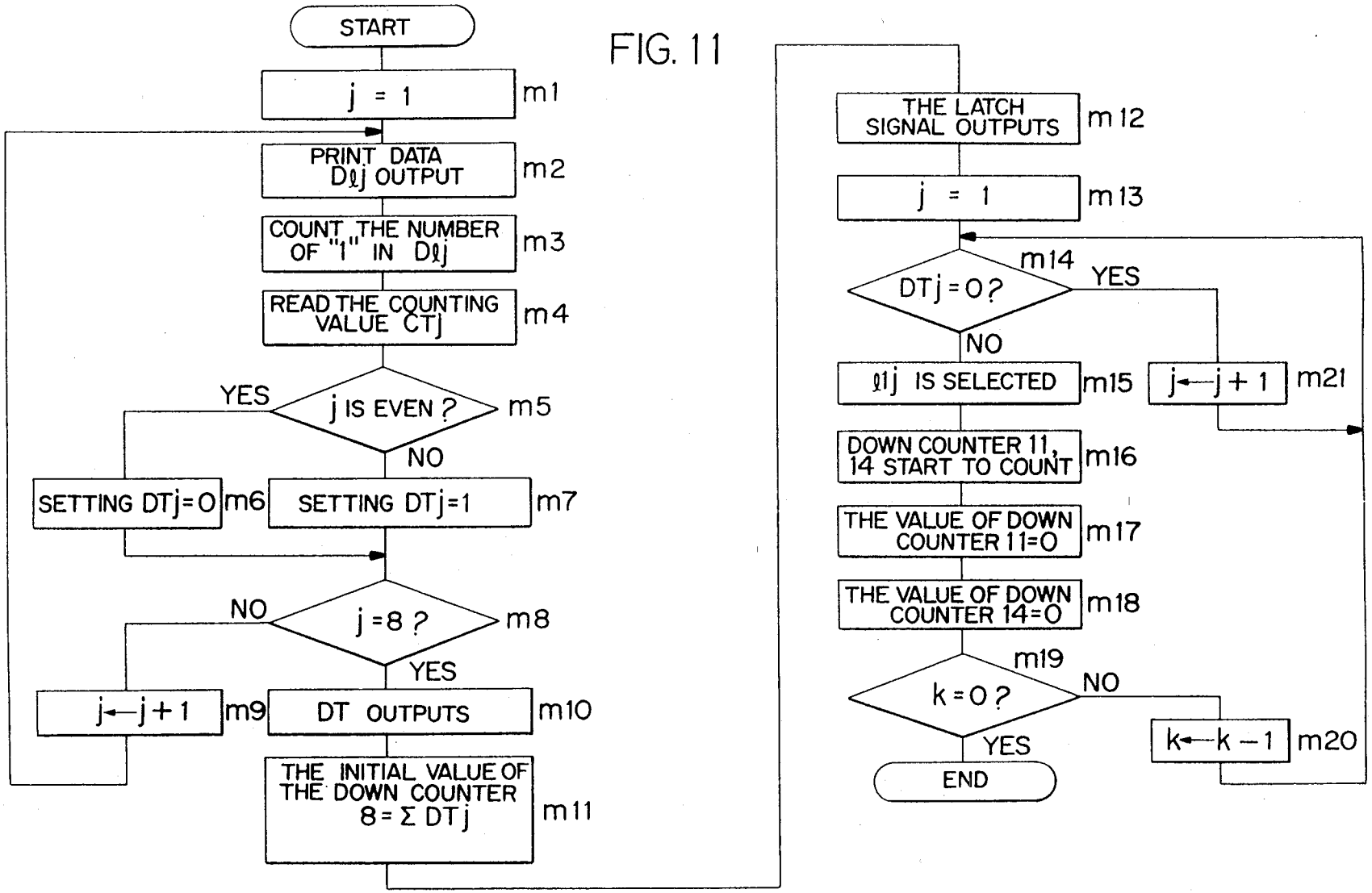
FIG. 11 is a flow chart for explaining an operation of the recorder 1*a*.

In the following, a recording operation of the recorder 1*a* in one line will be described with reference to a flow chart of FIG. 11. When recording one line, first a value of a parameter j is set to an initial value "1" in step m1. Then, in step m2, the print data Dlj related to the exothermic element Hji of the exothermic element group Hj corresponding to the parameter j is outputted from the central processing circuit 3. The print data Dlj is converted into the serial signal by the P/S converter 15 and in step m3, the counter 16 counts the number of exothermic elements Hji to be heated. When the print data of one of the exothermic element groups Hj has been counted, a count value CTj of the counter 16 is read out by the central processing circuit 3 in step m4.

In step m5, it is judged whether the count value CTj read out is "0". In the case of CTj=0, the procedure moves to step m6, wherein, for example, No. j bit DTj of the 8-bit parallel data DT is set to logic "0". When it is judged in step m5 that CTj≠0, the procedure is moved to step m7, wherein No. j bit DTj of the data DT is set logic "1". When the operations in steps m6 and m7 are completed, the procedure moves to step m8 to judge whether j=8. In the case of j≠8, in step m9, the value of the parameter j is incremented by +1 and the procedure is returned to the aforesaid step m2 to repeat the same operation, when j=8 in step m8, the procedure proceeds to step m10, wherein the data DT is outputted to the register 8 from the central processing circuit 3. Thereby, the data DT is given to the strobe signal generating circuit 12 from the register 8, and in step m11, a total number of bits which are "1" in the data DT are set as the initial value in the down counter 9.

Then, in step m12, the print data Dl led out to the shift register S is latched by the latch circuit L and led out to the "and" circuit A.

In step m13 onward, a generating operation of the strobe signal in the strobe signal generating circuit 12 is executed. When generating the strobe signal, the parameter j is set to an initial value of j=1 in step m13.

In step m14, the strobe signal generating circuit 12 judges whether the No. j bit DTj of the data DT from the register 8 is "0". In the case of DTj=0, the procedure moves to step m21 to increment the parameter j and returns again to step m14. In the case of DTj≠0, in step m15 the line l1j corresponding to the parameter j is selected.

In step m16, the down counters 11, 14 start counting down from the predetermined initial values. Since the initial value of the down counter 11 is set smaller than that of the down counter 14, the count value of the down counter 11 becomes "0" in step m17, and thereafter in step m18, the count value of the down counter 14 becomes "0".

Till the count value of the down counter 14 becomes "0" after the count value of the down counter 11 had become "0", data DT is outputted in the register 8 from the center of the strobe signal generating circuit 12 leads out the low level pulse signal to the line l1j selected in step m15 as the strobe signal STRj.

Thereafter, in step m19, it is judged whether the count value k of the down counter 9 is "0", in the case of k≠0, in step m20 the parameter j is incremented by +1 and the count value k of the down counter 9 is decremented by −1, and the procedure returns to the aforesaid step m14 to repeat the same operation. When the count value k of the down counter 9 is "0" in step m19, the printing operation of the line is completed. As described with reference to FIG. 10, in the operations in step m13 onward, the lead-out operations of print data of the following line are executed in parallel.

As such, in the present embodiment, the exothermic element Hji is heated selectively by the strobe signal STRj led out for every exothermic element group Hj, and when the exothermic element Hji to be heated is absent in the exothermic element group Hj, the strobe signal STR j corresponding to the exothermic element group Hj is not led out and the next strobe signal STRj+1 is outputted. Accordingly, since the strobe signal STRj unwanted is not outputted, the time wasted for outputting the strobe signal nevertheless the exothermic element for printing is absent can be saved, results in improvement of the printing speed. In particular, in the facsimile and the like, generally, there are large blank spaces in a document which are not needed to be printed, so that the printing speed can be considerably improved. Besides, since a powerful power circuit is not required to improve the printing speed, the high printing speed can be realized without increasing the cost and size of the apparatus.

In the embodiment, though the case wherein the invention is embodied in a facsimile including the exothermic elements H as the line-type thermal head has been described, it will be appreciated that it is not limited to the facsimile or the line-type thermal head, the invention can also be employed in connection with a common printer.

As described heretofore, according to the invention, when the number of printing elements to be driven in one line is small, the printing elements in a plurality of groups are arranged to be driven simultaneously, so that the printing speed can be improved without increasing the number of printing elements which are driven at the same time, thus without increasing the size of the apparatus resulting from, for example, a large power consumption of the printing elements. Furthermore, according to the invention, since the unnecessary driving signal is not outputted, or the number of printing means which are driven simultaneously is not increased, the printing speed can be improved without increasing the size of the apparatus resulting from a large power consumption of the printing means.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A printer including a plurality of printing elements and driving signal generating means for generating a driving signal, dividing the printing elements into a plurality of groups and selecting a respective group of printing elements, wherein while the driving signal is outputted for the selected group of printing elements, the selected group of printing elements are driven in response to print data to effect printing, further comprising:

print data output means for outputting the print data;

counting means for sequentially counting a number of printing elements to be driven for each of said plurality of groups in response to the print data from the print data output means;

comparison means for comparing a sum of counted values of the counting means in each of said plurality of groups, wherein the driving signal generating means, in response to the output of the comparison means, outputs the driving signal for selecting a first one of the plurality of groups when the sum of the counted values of the counting means is larger than a predetermined value, thereafter executing an output operation of the driving signal with respect to a group following immediately after, and wherein the driving signal generating means, in response to the output of the comparison means, outputs the driving signal for selecting at least a pair of said plurality of groups when the sum of the counted values of the counting means is less than a predetermined value;

a register which, in response to the output from the comparison means, stores first data when a sum of said counted values is smaller than a predetermined value, and stores second data when the sum of said counted values is larger than a predetermined value; and a down counter which counts either of said plurality of groups or a quotient of said plurality of groups divided by the counted number of printing elements within each of said plurality of groups as an initial value corresponding to the stored content of the register, wherein driving signal generating means is designed to decide the counted number of printing elements within each of said plurality of groups in response to the stored content of the register and the down counter.

2. A printer as claimed in claim 1, further comprising;

logic circuit which outputs print data from the print data output means for each of said plurality of printing elements, and disposed in every printing element, and in which an output/stop state of the print data for each of said plurality of printing elements is switched by the driving signal from the driving signal generating means.

3. A printer including a first plurality printing elements and driving signal generating means for generating a driving signal and dividing the first plurality of printing elements into a plurality of groups, and selecting a respective group to drive printing elements of the selected group, wherein while the driving signal is outputted for the selected group, the printing elements are driven in response to print data to effect printing, further comprising:

print data output means for outputting the print data;

counting means for sequentially counting a number of printing elements to be driven for in response to the print data from the print data output means; and means for storing the counted number of printing elements for, wherein the driving signal generating means, when a count value of said counting means is zero, does not output the driving signal for selecting the group corresponding to the count value of the printing elements, but executes an output operation of the driving signal for selecting the following group whose count value is not zero.

4. A printer as claimed in claim 3, further comprising:

a logic circuit which outputs print data from the print data output means for each of said first plurality of printing elements and disposed in each of said first plurality of printing elements, and in which an output/stop state of the print data for each of said plurality of printing elements is switched by the driving signal from the driving signal generating means.

5. A printer as claimed in claim 3, further comprising:

a register which, in response to the output from the counting means, stores digit data corresponding to whether or not the count value of each of said plurality of groups is zero; and a down counter which counts a number of digits of data among the digit data stored in said register whose count value is not zero, wherein at least one of said plurality of groups is selected in response to the stored contents of the register and the down counter.

* * * * *